United States Patent [19]

Bhattacharjee et al.

[11] Patent Number: 4,457,992

[45] Date of Patent: Jul. 3, 1984

[54] ETCHABLE ELECTROPHOTOGRAPHIC LONG-RUN PRINTING PLATE AND METHOD OF MAKING SAME

[75] Inventors: Himangshu R. Bhattacharjee, Rockaway; Frederick R. Hopf, Parsippany; Karl W. Beeson, Princeton, all of N.J.

[73] Assignee: Allied Corporation, Morris Township, Morris County, N.J.

[21] Appl. No.: 492,771

[22] Filed: May 9, 1983

[51] Int. Cl.[3] ..... G03G 13/26

[52] U.S. Cl. ..... 430/49; 430/89; 430/96; 430/327; 101/462

[58] Field of Search ..... 430/49, 96, 89, 327; 101/462; 526/273

[56] References Cited

U.S. PATENT DOCUMENTS

| | | | |
|---|---|---|---|
| 3,348,944 | 10/1967 | Michalchik | 430/96 |
| 3,581,661 | 6/1971 | Flechner | 430/49 X |
| 4,168,165 | 9/1979 | Kato | 430/49 X |
| 4,226,930 | 10/1980 | Takimoto | 430/126 |

*Primary Examiner*—John D. Welsh

*Attorney, Agent, or Firm*—Thomas D. Hoffman; Gerhard H. Fuchs; Alan M. Doernberg

[57] ABSTRACT

An etchable electrophotographic printing plate comprising a coating on a surface of an electroconductive support such as grained, anodized aluminum of effective amounts of photoconductive ZnO and of a sensitizing dye dispersed in an organic resin binder comprised of about 60–90 wt. % of $C_2$–$C_4$ alkenyl $C_2$–$C_8$ alkanoate, about 5–30 wt. % of di($C_1$–$C_8$ alkyl) $C_4$–$C_8$ alkenedionate, about 2–8 wt. % of $C_3$–$C_8$ alkenoic acid or $C_4$–$C_8$ alkenedioic acid, and about 0.5–5.0 wt. % of a cross-linking agent. The preferred thermally cross-linkable organic resin binder is a random copolymer of 70 wt. % vinyl acetate, 24 wt. % dibutyl maleate; 5 wt. % acrylic acid and 1 wt. % glycidyl methacrylate. The etchable printing plate of the present invention is environmentally safe, has excellent shelf life and high sensitivity to actinic radiation. A process of image-wise exposure of the etchable electrophotographic printing plate to a low-power laser combined with an environmentally-safe aqueous etchant to prepare a printing plate that provided 100,000 good quality impressions is also disclosed.

29 Claims, 5 Drawing Figures

ETCHABLE ELECTROPHOTOGRAPHIC LONG-RUN PRINTING PLATE AND METHOD OF MAKING SAME

DESCRIPTION

1. Field of the Invention

This invention relates to an etchable electrophotographic printing plate and a method of making same. More particularly this invention relates to an etchable electrophotographic printing plate comprising a selected electrophotoconductive support having a surface coating of dye-sensitized zinc oxide and selected organic resin binder compositions.

2. Description of the Prior Art

Electrophotography is an imaging process that typically involves placing a uniform charge on the surface of a photoconductor in the dark; imagewise exposing the charged photoconductor, thereby discharging it in the exposed areas; and applying to the surface a toner that is preferentially drawn to (or repelled from) the charged areas. To form a lasting image, the toner may then be fused on the surface or, alternatively, transferred to and fused on a receptor. Optionally, as is described in U.S. Pat. Nos. 2,952,536 and 2,957,765, treatment with a conversion solution containing, for example, ferrocyanide ions, can render toned and untoned areas oleophilic and hydrophilic, respectively, to provide a lithographic printing plate.

Photoconductive zinc oxide, dispersed in a resin binder, and, optionally, dye-sensitized is a well known system for electrophotography (see, e.g., R. M. Schaffert, *Electrophotography,* Focal Press, New York, 1973). Typically, a zinc oxide/resin binder system is coated on a base metal plate such as aluminum, zinc, or stainless steel, or even on paper, and a toned image formed on its surface is fixed directly on the coating, without need to transfer the image to a receptor.

Resin binders suitable for use with zinc oxide in photoconductive compositions and, in particular, resin binder blends (or mixtures) have been disclosed in U.S. Pat. No. 3,345,162, issued Oct. 3, 1967, to S. B. McFarlane, Jr. et al.; U.S. Pat. No. 3,347,670, issued Oct. 17, 1967 to G. R. Nelson et al.; and U.S. Pat. No. 3,615,419, issued Oct. 26, 1971, to S. Field. A crosslinking, insulating, film forming resin binder selected from soluble solid epoxy resin of diglycidyl ether of bisphenol A, a blend of said epoxy resin with an intermediate silicone resin or a prepolymer of said epoxy resin with said silicone resin is disclosed in U.S. Pat. No. 3,368,893 issued on Feb. 13, 1968 to W. L. Garrett et al. Styrene acrylate resins as binders for photoconductive compositions are disclosed in U.S. Pat. No. 3,540,886, issued Nov. 17, 1970, to R. E. Ansel, et al. Vinyl acetate resin binders are disclosed in U.S. Pat. No. 3,378,370, issued Apr. 16, 1968, to S. T. Brancato; U.S. Pat. No. 3,607,376, issued Sept. 21, 1971 to R. B. Blance et al.; and U.S. Pat. No. 3,745,006 issued July 10, 1973 to R. B. Blance et al.

Among the dyes that have been found to be useful for spectral sensitization of zinc oxide are cyanine dyes, fluorescein dyes, rosaniline dyes, erythrosin dyes, rose bengal, bromophenol blue, malachite green, crystal violet, basic fuchsin, methyl green, brilliant green, methylene blue, acridine orange, alizarin red and other dye systems more fully described in the following U.S. Pat. Nos., namely: 3,132,942; 3,121,008; 3,110,591; 3,052,540; 3,051,569; 2,959,481; 3,047,384; 3,125,447; 3,128,179; 3,250,613; 3,250,615; 3,469,979; 3,271,144; 3,274,000; 3,346,161; 3,403,023 and 3,619,154 amongst others. The use of indocyanine green as a laser dye has been disclosed in IEEE J. Quant. Electr., QE-11,40,114 (1975). Similar dyes as sensitizers in thermally-stable, infrared-sensitive photoconductive compositions have been disclosed in U.S. Pat. No. 4,362,800 issued Dec. 7, 1982.

Zinc oxide electrophotographic coatings containing cyanine sensitizers and multicomponent binders were disclosed by W. C. Park in his U.S. Pat. No. 3,682,630, issued Aug. 8, 1972, and his paper-TAPPI, 56, 101 (1973).

Electrophotographic compositions containing zinc oxide dispersed in a certain resin binder mixture and sensitized with a cyanine dye having a particular structure providing high sensitivity in the 780–840 nm wavelength range is disclosed in U.S. patent application Ser. No. 421,703, now U.S. Pat. No. 4,418,135 (K. W. Beeson et al.)

The use of a laser diode as an exposure source for recording on electrophotographic material was disclosed by A. Stramondo in 1980 Proceedings of Lasers in Graphics, Electronic Publishing in the 80's Conference, Vol. 1, page 1–27.

SUMMARY OF THE INVENTION

In accordance with the present invention, we provide an etchable electrophotographic printing plate comprising:

(a) an electroconductive support;

(b) a coating on a surface of the electroconductive support of effective amounts of a photoconductive zinc oxide and of a sensitizing dye dispersed in an organic resin binder, wherein said resin comprises about 60–90 weight percent of $C_2$–$C_4$ alkenyl $C_2$–$C_8$ alkanoate, about 5–30 weight percent of di($C_1$–$C_8$ alkyl) $C_4$–$C_8$ alkenedioate, about 2–8 weight percent of $C_3$–$C_8$ alkenoic acid or $C_4$–$C_8$ alkenedioic acid, and about 0.5–5.0 percent of a cross-linking agent.

In accordance with the present invention we also provide a process of preparing an etchable electrophotographic printing plate which comprises:

(a) coating onto a face of an electroconductive support a suspension comprising effective amounts of (1) an organic resin binder; (2) photoconductive zinc oxide; and (3) a sensitizing dye dispersed in an amount of an anhydrous solvent mixture comprising at least about 10 volume percent of a $C_1$–$C_8$ alcohol and no more than about 90 volume percent of an aromatic and/or alkyl aromatic hydrocarbon sufficient to dissolve said organic resin and said sensitizing dye and to disperse said zinc oxide; and (b) drying said thin film for a time sufficient to remove substantially all said solvent mixture and produce an etchable electrophotographic plate;

wherein said organic resin comprises about 60–90 weight percent of $C_2$–$C_4$ alkenyl $C_2$–$C_4$ alkanoate, about 5–30 weight percent of di($C_1$–$C_8$ alkyl) $C_2$–$C_8$ alkenedioate, about 2–8 weight percent of a $C_3$–$C_8$ alkenoic acid or $C_4$–$C_8$ alkenedioic acid and about 0.5–5.0 weight percent of a cross-linking agent.

In operation, we provide a process for preparing an electrophotographic image on the etchable electrophotographic printing plate comprising the sequential steps of electrically charging the top surface of said printing plate coated with a photoconducting composition of the type described above to a voltage in the range of about 50 to 800 volts, imagewise exposing the charged surface to a monochromatic beam of actinic radiation, whose wavelength is in the range between about 350 and about 900 nm; toning the sheet with an electrostatic toner to produce a toned image; heating said plate at a temperature and for a time sufficient to fuse the toner on the visual image onto the surface of said plate; treating the surface of said plate with basic aqueous solution such as $C_2$–$C_8$ alkylamine, $C_1$–$C_8$ alkanolamine, a polyfunctional amine having formula $NH_2[(CH_2)_nNH]_m(CH_2)_nNH_2$ wherein n is 1 or 2 and m is 1–8, alkali metal metasilicate, alkali metal phosphate, or other aqueous base known to someone skilled in the art for a time sufficient to remove the coating comprising organic resin binder, photoconductive zinc oxide, and sensitizing dye in the region wherein said coating is not protected by the toner; and optionally treating the surface of said plate with an acidic aqueous solution comprising phosphoric acid or a $C_2$–$C_4$ alkanoic acid for a time sufficient to remove residual photoconductive zinc oxide at the interface of imaged and non-imaged areas. Furthermore, the etched plate is optionally heated again to strengthen the imaged areas and enhance the endurance of the plate on an offset printing press.

The etchable electrophotographic plate of the present invention utilizes inexpensive zinc oxide dispersed in a selected thermally cross-linkable organic resin binder on an electroconductive support such as an aluminum plate. As such the electrophotographic plate of the present invention is environmentally safe, has excellent shelf life, and high sensitivity to actinic radiation in the 350–900 nm range. The present invention provides for an environmentally safe aqueous etchant to strip away the coating from the non-imaged areas of the plate. The printing plate prepared in accordance with the present invention provided 100,000 good quality impressions in a medium speed printing press.

In a preferred imaging process, the exposure source is a low-power laser, such as a diode laser, helium-neon laser, or helium-cadmium laser, which provides substantial advantages of low cost and simplicity over alternative sources.

BRIEF DESCRIPTION OF THE DRAWINGS

FIG. 2(*b*) illustrates the toned region of the electrophtographic printing plate of FIG. 2(*a*) after etching of the background area in accordance with the present invention.

FIG. 3(*b*) is a photograph of the 100,000th impression produced by the etched printing plate of the present invention.

DETAILED DESCRIPTION OF THE INVENTION

The present invention provides an aqueous-alkaline etchable zinc oxide electrophotographic printing plate comprising coatings of inexpensive zinc-oxide dispersed in selected thermally cross-linkable organic resin binders on a surface of an electroconductive support that has several advantages over those of the prior art and, in addition, provides an economical process for exposing the coated electrophotographic plate with a low power visible or near infrared laser or other low intensity light source.

The newspaper and commercial printing industry has a need for a relatively inexpensive printing plate having high sensitivity to visible or near infrared light, having high resolution capabilities, and having the potential for generating a large number of impressions in offset printing. The etchable electrophotographic plate provided by the present invention satisfies this need by utilizing low cost materials while providing a printing plate that can generate over 100,000 impressions having a resolution of at least about 15–20 line pairs per mm and as such suitable for newspaper graphics. This plate is compatible with the modern laser-imaging-typesetting technology whereby a low power laser is used to expose the coated electrophotographic plate of the present invention; the exposed plate is hence fused and etched by an environmentally safe one or two-step aqueous etching system to provide a long run printing plate having good resolution.

Figure 1:
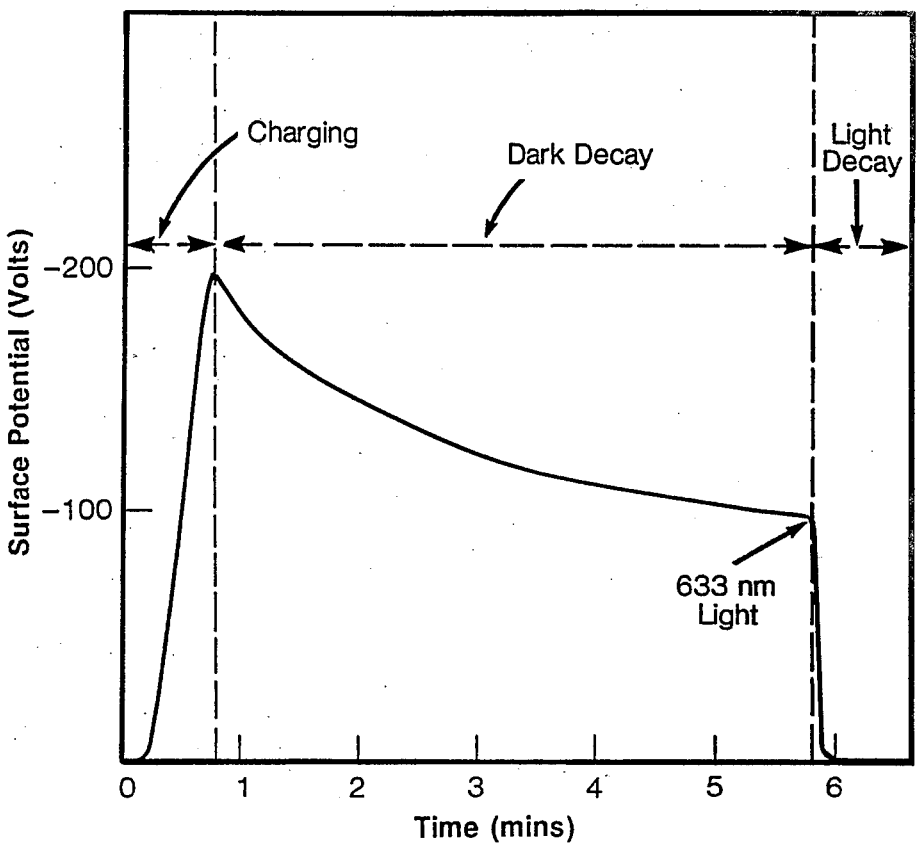
FIG. 1 graphically illustrates the variation of the surface potential of the etchable electrophotographic printing /plate of the present invention with time during charging, dark decay and photodischarge.
Figure 2A:
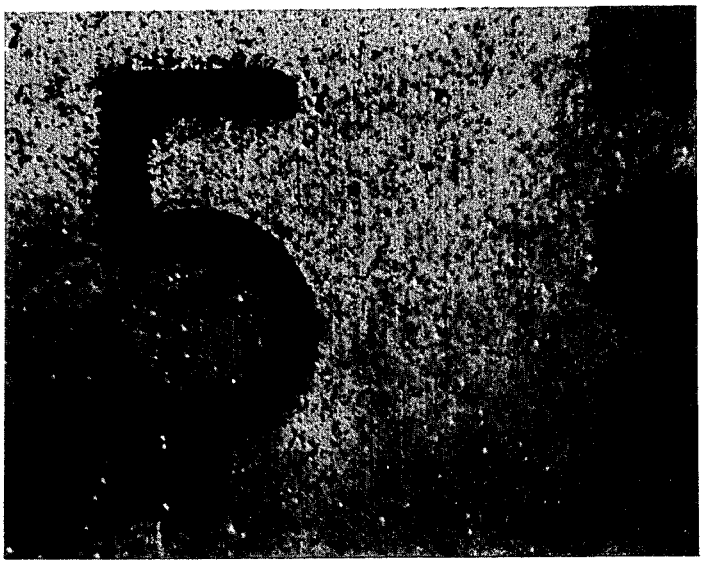
FIG. 2(*a*) illustrates a toned region of the electrophotographic printing plate of the present invention before background materials were etched away.
Figure 2B:
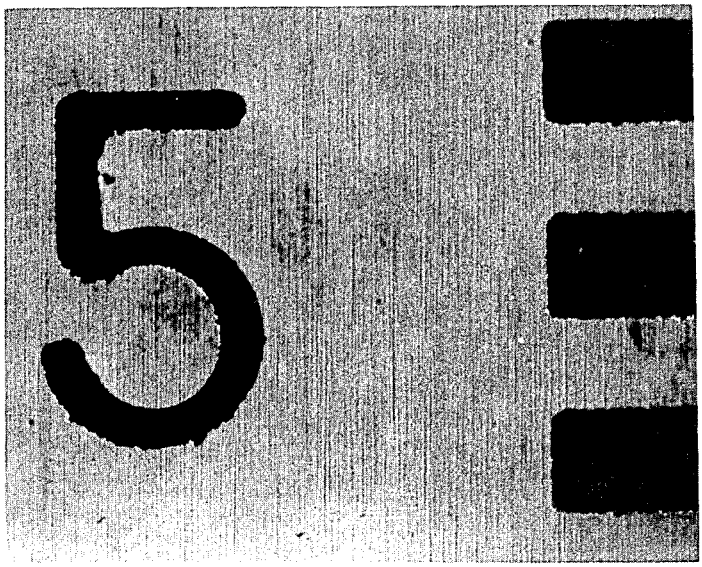

Two factors, dark decay rate and photosensitivity, are important in the formulation of films for direct laser imaging. With relatively low output sources such as a helium-neon, helium-cadmium, or diode laser, materials must have sufficient photosensitivity to produce high contrast images. Likewise, the surface potential of the material must remain sufficiently high during the entire imaging cycle (i.e., low dark decay rate) to insure uniform background quality. There is generally an inverse relationship between photosensitivity and dark decay time. FIG. 1 shows a typical sequence of charging, dark decay, and photodischarging for a preferred embodiment of the present invention.

The etchable electrophotographic printing plate of the present invention uses zinc oxide powder that is commercially available for electrophotographic applications. Typical of suitable material is Photox®-80, available from New Jersey Zinc Company. The other elements of the electrophotographic printing plate are a selected organic resin binder and sensitizing dye. The weight ratio of zinc oxide to the selected organic resin binder is preferably in the range from about 3:1 to about 10:1, with 4:1 to 5:1 more preferred.

Organic resin binders found useful in the present invention have the following characteristics:

(a) soluble in aqueous dilute base;

(b) readily cross-linkable;

(c) good electrophotographic behavior, i.e., does not interfere with charging or photodischarging nor adversely affect the photosensitivity of the zinc oxide/organic resin binder/sensitizing dye composite coated on the plate; and (d) durability under printing press conditions, i.e., excellent adhesion to the electro-conductive support.

Among the organic resin binders found useful in the present invention are organic resin binders comprising about 60–90 weight percent of $C_2$–$C_4$ alkenyl $C_2$–$C_8$ alkanoate, about 5–30 weight percent of di($C_1$–$C_8$ alkyl)$C_4$–$C_8$ alkenedioate, about 2–8 weight percent of a $C_3$–$C_8$ alkenoic acid and about 0.5–5.0 weight percent of a cross-linking agent. The preferred organic resin binder comprises about 70 weight percent of a $C_2$–$C_4$ alkenyl $C_2$–$C_8$ alkanoate, about 24 weight percent of a di($C_1$–$C_8$ alkyl) $C_4$–$C_8$ alkenedioate, about 5 weight percent of a $C_3$–$C_8$ alkenoic acid or $C_4$–$C_8$ alkenedioic acid and about 1 weight percent of an epoxy containing cross-linking agent.

The $C_2$–$C_4$ alkenyl $C_2$–$C_4$ alkanoate may be vinyl, alkyl, propenyl and isomeric butenyl esters of acetic, propionic or butyric acid. The preferred alkenyl alkanoate is a vinyl alkanoate, more preferably vinyl acetate. The di($C_1$–$C_8$ alkyl) $C_4$–$C_8$ alkenedioate may be normal and isomeric $C_1$–$C_8$ alkyl esters of cis and transbutenedioic acid, i.e., maleic acid, fumaric acids, alkyl substituted butenedioic acids, such as dimethylmaleic acid, dimethylfumaric acid or itaconic acid, isomeric pentenedioic acids, such as ethylene and ethylidenemaleic acid (methyl itaconic acid), methyl-, ethyl-, and propyl-substituted pentenedioic acids, isomeric hexenedioic acids, isomeric heptenedioic acids and isomeric octenedoic acids. The preferred di($C_1$–$C_8$ alkyl) $C_4$–$C_8$ alkenedioate is dibutyl maleate. The $C_3$–$C_8$ alkenoic acids may be propenoic (acrylic), butenoic (e.g., crotonic), pentenoic, hexenoic, heptenoic and octenoic acids and isomers thereof. The preferred $C_3$–$C_8$ alkenoic acid is acrylic acid. The $C_4$–$C_8$ alkenedioic acids are the same as listed above. The cross-linking agent is normally an epoxy-containing compound, especially glycidyl esters of polymerizable alkenoic acids such as acrylic, crotonic, methacrylic or monomethyl ester of maleic acid. The preferred cross-linking agent is glycidyl methacrylate.

Sensitizing dyes useful in the present invention should be able to sensitize the photoresponse of zinc oxide to wavelengths in the range of 350–900 nm. Sensitizing dyes can be one or more of the following dyes: sodium fluorescein, eosin dyes, rose bengal, malachite green, anthraquinone green, brilliant green, methylene blue, bromophenol blue, bromocresol purple, bromothymol blue, erythrosin dyes, and cyanine dyes. Other dye systems compatible with zinc oxide are also considered to be within the scope of the present invention. In the broadest embodiments, the coating comprises at least about 0.001 to about 0.05 weight percent of the sensitizing dye. The preferred dye for sensitization to a helium-neon laser is bromophenol blue. The preferred dye for sensitization to a diode laser is indocyanine green.

The electroconductive support of the present invention may be an aluminum or stainless steel plate or a conductive plastic sheet. Preferably, the substrate has resistivity less than about $10^9$ ohm-cm. Grained, anodized aluminum is preferred because it is relatively inexpensive. Thermoplastic films having conductive coatings or additives are also suitable. Exemplary of a suitable material is poly(vinyl chloride) loaded with conductive carbon to provide resistivity in the desired range. Additional materials of this type are described in Plastics Technology 27, 67 (1981), and that disclosure is incorporated herein by reference.

The present invention contemplates the preparation of an etchable electrophotographic printing plate which comprises coating onto a face of an electroconductive support, e.g., grained, anodized aluminum, a suspension comprising effective amounts of (1) the selected organic resin binder described hereinabove; (2) photoconductive zinc oxide; and (3) a sensitizing dye described hereinabove in an amount of an anhydrous solvent mixture comprising at least about 10 volume percent of a $C_1$–$C_8$ alcohol, preferably a $C_1$–$C_3$ alcohol, conveniently anhydrous ethanol, and no more than about 90 volume percent of an aromatic and/or alkyl aromatic hydrocarbon, conveniently toluene or isomeric xylenes, sufficient to dissolve the selected organic resin binder and sensitizing dye and to disperse the zinc oxide followed by drying the thin film for a time sufficient to remove substantially all of the solvent mixture. It is critical to the preparation of the coating mixtures of the present invention that the dispersing solvent mixture be sufficiently dry. The preferred solvent mixture is anhydrous and comprises about 3 volumes of a $C_1$–$C_3$ alcohol, especially anhydrous ethanol and about 4 volumes of an alkyl aromatic, especially anhydrous toluene.

Coating thickness of the composition is important. Nominal coating thickness of about 5 to 50 μm has been used successfully. If thickness is too low, charge acceptance is reduced, while high coating thickness results in low resolution. Generally, coating thickness in the range from about 10 μm to about 20 μm is preferred.

In use, the coating is charged, imagewise exposed to light to form a latent image, toned, and the toner fused. As is generally true with zinc oxide compositions, negative charge is preferred.

Imaging can be done using light from either a conventional lamp transmitted through a filter and mask or from a modulated laser beam raster scanned across the plate. Low power lasers are a preferred exposure source because they provide a high intensity beam that can be focused to a small spot and because they are relatively inexpensive. Typical low power laser sources are diode, helium-neon, and helium-cadmium lasers. Diode lasers emitting in the wavelength range of 780–840 nm are well known and commercially available. Exemplary are AlGaAs laser diodes emitting at about 820 nm and available from Mitsubishi Electric Corp. Helium-neon lasers are available from Coherent Inc. and other sources. Helium-cadmium lasers are available, for example, from Omnichrome.

The latent electrostatic image formed by conventional lamp or laser light exposure is toned to form a visible image. Conventional toners, either dry powder or liquid, well known in the art, may be used. Whether a positive or negatively charged toner is necessary depends on whether the light exposure photodischarged the non-image or image areas of the plate. If the non-image areas were photodischarged, positively charged toners are used which are preferentially attracted to the negatively charged image. A suitable positively charged dry toner is EP310 produced by Minolta Corporation. On the other hand, if the exposure light discharged the image areas of the plate, a regatively charged toner is used which will preferentially tone the image areas and be repelled by the negatively charged non-image areas. Star-54 toner produced by Philip A. Hunt Chemical Corp. is a suitable negatively charged dry toner. Once a toned image is formed, the toner is fused with heat in such a way that no significant cross-linking of polymer occurs in the non-image areas of the plate coating.

A lithographic printing plate is prepared from the toned and fused image by treating the surface of the plate with a basic aqueous solution comprising $C_2$–$C_8$ alkylamine, $C_1$–$C_8$ alkanolamine, a polyfunctional amine having formula $NH_2[(CH_2)_nNH]_m(CH_2)_nNH_2$ wherein n is 1 or 2 and m is 1–8, alkali metal metasilicate, alkali metal phosphate, or other aqueous base known to someone skilled in the art for a time sufficient to remove the coating comprising organic resin binder, photoconductive zinc oxide, and sensitizing dye in the region wherein said coating is not protected by the toner. When necessary, the surface of the plate is further treated with an acidic aqueous solution comprising phosphoric acid or a $C_2$–$C_4$ alkanoic acid for a time sufficient to remove residual photoconductive zinc oxide at the interface of imaged and non-imaged areas. The preferred basic aqueous solutions are alkali metal metasilicate, especially sodium metasilicate and alkali metal phosphate, especially trisodium phosphate ($K_3PO_4 \cdot nH_2O$) as 1–5 weight percent aqueous solution. The preferred acidic aqueous solutions are 2–4 weight percent phosphoric acid or 2–4 weight percent propanoic acid in water. The reactivity of zinc oxide with organic acid and aqueous inorganic acids is disclosed in *Zinc Oxide Rediscovered,* prepared by the New Jersey Zinc Co. New York, N.Y. 1957 at pages 72–74.

To produce a more durable printing plate, the plate may optionally be heated after the etching procedure to further fuse the toner and to crosslink the polymer resin-zinc oxide-dye coating under the toned image. The resulting plate is ready for use on an offset printing press.

The following examples are presented in order to provide a more complete understanding of the invention. The specific techniques, conditions, materials, and reported data set forth to illustrate the principles and practice of the invention are exemplary and should not be construed as limiting the scope of the invention.

EXAMPLE 1

A random copolymer of 70% vinyl acetate, 24% dibutyl maleate, 5% acrylic acid and 1% glycidyl methacrylate (all % by weight) was prepared using $\alpha,\alpha'$-azodiisobutyronitrile (AIBN) as the polymerization initiator. A starting mixture containing 103.8 g vinyl acetate (Monomer-Polymer Corporation), 37.5 g dibutyl maleate (Aldrich), 0.7 g acrylic acid (Celanese), 0.15 g glycidyl methacrylate (Aldrich), and 0.75 g AIBN (Polysciences) was placed in a 500 ml temperature controlled resin kettle equipped with stirrer, thermometer, dropping funnel, and reflux condenser. The kettle was flushed with nitrogen for 30 minutes prior to heating the mixture. The temperature of the reactor was increased to 60° C. and maintained at that level during the polymerization reaction. The remaining 90% of the acrylic acid (1.35 g) and glycidyl methacrylate (6.5 g) were mixed with 25 g of denatured ethanol (Matheson, Coleman, and Bell) and slowly added to the reaction mixture over a period of four hours. An additional 0.3 g of AIBN and 125 g of denatured ethanol were added and stirring and heating continued until the product became homogeneous. The solution appeared cloudy and colorless. A Brookfield viscosity of 3000 centipoise was measured at 20° C.

An etchable electrophotographic printing plate was produced using the polymer resin described above. First, a coating mixture was prepared by mixing 46 g of the polymer solution described above with 100 ml of toluene (Allied Chemical, semiconductor grade) and 60 ml of anhydrous ethyl alcohol (U.S. Industrial Chemicals Co.). To this mixture, 122.5 g of zinc oxide (Photox-80, New Jersey Zinc) was slowly added and stirred with a glass rod. The zinc oxide was previously heated overnight at 120° C. to remove any adsorbed water. The weight ratio of zinc oxide to binder was approximately 5:1. The mixture was placed in a stainless steel high speed explosion-resistant Waring blender and blended for a total of 3 minutes. After each minute of blending, the mixture was cooled by dipping the mixing container in ice water for 30 seconds. The extent of blending was determined by measuring the fineness of grind with a Hegman gauge (a Hegman reading of 4 to 6 was acceptable). After the last cooling step, 1.5 ml of 1% (by weight) of bromophenol blue dye (12 mg of solid dye) in ethanol was added. The final mixture was blended for an additional 30 seconds in 15 second intervals.

A grained and anodized aluminum sheet (18"×11"×0.006", Pitman Co., Secaucus, N.J.) was coated with the zinc oxide-resin-dye mixture using a Mayer rod (No. 24) coater. The coated plate was dried overnight inside an efficient hood and was placed in total darkness for 24 hours prior to use.

A toned image was produced on the plate using a flatbed laser scanning system. The flatbed system consisted of a plate holder, a plate transport mechanism driven by a stepping motor, a scoratron charger, a helium-neon laser scanner, and a dry toning device. Information to be imaged was composed and typeset on the computer terminal of a Mergenthaler Omnitech 2000 laser typesetter. The Omnitech 2000 was also connected to the flatbed scanning system and controlled the plate transport speed, laser scanning, and laser modulation. To tone a plate, the plate was first mounted onto the plate holder and held in position by a partial vacuum. The plate was transported at a rate of 1.0 inch/sec across the scoratron charger (the charger grid was held at −280 volts) which charged the photoconductive coating to a surface potential of about −300 volts. The plate was then imagewise exposed by a 2 mW helium-neon laser which was raster scanned across the plate and which photodischarged the non-image areas of the plate. The laser spot size was 1.4 mils in diameter and the plate transport speed during imaging was about 0.05 inch/sec. Finally, the plate was transported at 0.25 inch/sec across a magnetic brush toning device. Positively charged toner particles (Minolta EP310 developer) were attracted to the undischarged areas of the plate.

The toned plate was removed from the imaging system and placed on a second motor-driven flatbed device for toner fusing. The plate was passed three times at a rate of 0.1 inch/sec under a Vycor brand 1000 watt infrared heater held 1 inch above the plate surface. The heater preferentially fused the toner but did not appreciably crosslink the polymer resin in the untoned areas of the plate.

After fusing, the zinc oxide-resin-dye coating in the non-imaged areas of the plate was removed by etching with an aqueous-alkaline solution of 4% sodium metasilicate, $Na_2SiO_3 \cdot 9H_2O$, pH=12. Removal of the coating was facilitated with simultaneous mechanical brushing. The plate was rinsed with tap water and dipped in an aqueous solution of 3% phosphoric acid for 1½ minutes to remove any zinc oxide remaining at the interface of the imaged and the non-imaged areas after the alkaline etch. The etched plate was rinsed with tap water and dried. To further fuse the toner and to crosslink the resin coating underneath the toned areas, the plate was again passed 3 times under the Vycor 1000 watt heater at a rate of 0.1 inch/sec.

The resulting printing plate was tested on a sheet-fed medium speed AM-1250 printing press operating at 8500 pages/hour. Before the plate was mounted on the press, it was treated with Van Son V2021 conversion solution (full strength) to make the bare aluminum surface fully water receptive. The fountain solution used during the press run was Van Son V2026 solution diluted 7 times in distilled water and the printing ink was Van Son VS157 electrostatic black. The press run was stopped after 5000 copies with no visible deterioration of the image quality.

EXAMPLE 2

A printing plate was coated, charged, imagewise exposed, toned, and fused in accordance with the procedure described in Example 1. After fusing, the zinc oxide-resin-dye coating in the non-imaged areas was removed by etching with a solution of 4% sodium metasilicate and by mechanical brushing. The etched plate was rinsed with tap water and dried. The printing plate was postbaked by passing the plate under a Vycor 1000 watt heater 3 times at a rate of 0.1 inch/sec. The distance from the heater to the plate was 1 inch. The resulting plate was ready to be put on a printing press.

EXAMPLE 3

An etchable electrophotographic printing plate was prepared as follows: 46 g of Monsanto 270T resin solution (55% solids) was mixed with 95 ml of toluene and 70 ml of anhydrous ethyl alcohol. To this mixture, 122.5 g of Photox-80 zinc oxide was slowly added and stirred with a glass rod. The mixture was blended in accordance with Example 1. After blending, 1.5 ml of 1% bromophenol blue dye in ethanol was added. The final mixture was blended for an additional 30 seconds in 15 second intervals.

A grained and anodized aluminum sheet was coated with the mixture, charged, imagewise exposed, toned, and fused as in Example 1. After fusing, the zinc oxide-resin-dye coating in the non-imaged areas of the plate was removed by etching with an aqueous-alkaline solution of 4% sodium metasilicate and by mechanical brushing. The etched plate was rinsed in tap water and dried. The plate was not postbaked.

The resulting printing plate was tested on an AM-1250 printing press in accordance with Example 1. The press run was stopped after 30,000 copies with no apparent deterioration of the image quality.

EXAMPLE 4

To produce an etchable electrophotographic printing plate, a mixture was prepared using 111.4 g of Monsanto 270T resin solution and 295 ml of toluene (Allied Chemical, semiconductor grade). To this mixture, 245 g of Photox-80 zinc oxide was slowly added and stirred with a glass rod. The weight ratio of zinc oxide to binder was 4:1. The mixture was placed in a stainless steel high-speed Waring blender and blended for a total of 3 minutes. Blending temperatures were kept below 60° C. The extent of blending was determined by measuring the fineness of grind with a Hegman gauge and was found to be in the range of 4–6. Finally 3.0 ml of 1% bromophenol blue dye in ethanol was added to the mixture and the mixture blended for an additional 30 seconds.

Grained and anodized aluminum sheets (18"×11"×0.006") were coated with the zinc oxide-resin-dye mixture using a Mayer rod (No. 24) coater. The coated plates were dried overnight in an efficient hood. Samples were cut to the proper size for absorbance and electrophotographic measurements and were placed in total darkness for 24 hours prior to testing.

The spectral reflectance of the plate was measured on a Cary 219 spectrophotometer. The sample displayed an absorbance maximum at 630 nm, the characteristic value for bromophenol blue dye. Electrophotographic properties, including charging, dark decay and photosensitivity were studied under controlled conditions of temperature (T=20 to 25° C.) and relative humidity (RH =50 to 60%) on a Victoreen electrostatic sample analyzer equipped with a control grid. The grid voltage was approximately −280 volts. A typical measurement involved charging a piece of the plate (3"×4") to −200 volts by means of a corona discharge, turning off the charger and noting the time for the voltage to decay in the dark to −100 volts. Typical dark decay times of 5 minutes or greater were recorded at T=22° C. and RH approximately 50%. Photosensitivity of the plate was determined by shining 633 nm light (isolated by an interference filter from the output of a tungsten lamp built inside the Victoreen) on the plate once the surface voltage had decayed to −100 volts. The light intensity at 633 nm was determined to be 0.5)W/cm$^2$ with a photodiode manufactured by United Detector Technology. FIG. 1 shows typical charging and discharging curves of the present plate at 21° C. and 50% relative humidity. From the observed light induced decay time of 8 sec, we estimated a photosensitivity of 40 ergs/cm$^2$ for discharging the plate from −100 volts to near zero volt.

To prepare an image, we utilized a flatbed projection system. A coated plate was mounted on a slow moving flatbed (0.5 inch/sec) and charged to −380 volts by means of a scoratron charging device. After 20 seconds or so the plate was exposed for 15 seconds to visible light transmitted through a 1951 USAF negative test pattern target. A Beseler 23CII enlarger with a Rodagon 50 mm lens was used to make a 5 times magnified image of the pattern. The plate was then removed and the latent image was developed by cascading Philip Hunt's Star-54 dry developer over the surface. Hunt's Star-54 has negatively charged toner particles which are preferentially attracted to the discharged areas (as negative charges remain elsewhere) of the plate. The powdered image areas were then fused by the following heating process. The plate was put on a second motor-driven flatbed and was passed twice under a Vycor brand 1000 watt infrared heater held one inch above the plate surface. The total heating time was 2 minutes. The heater preferentially fused the toner but did not appreciably crosslink the polymer resin in the untoned areas of the plate.

Following this treatment, the zinc oxide-resin-dye coating in the non-imaged areas of the plate was removed by brushing with a 20% solution of ethanolamine. The plate was washed thoroughly and was allowed to dry. To provide for further crosslinking of the toner and the remaining zinc oxide-resin-dye coating, the etched plate was heated with a heat gun for one minute.

Figure 3A:
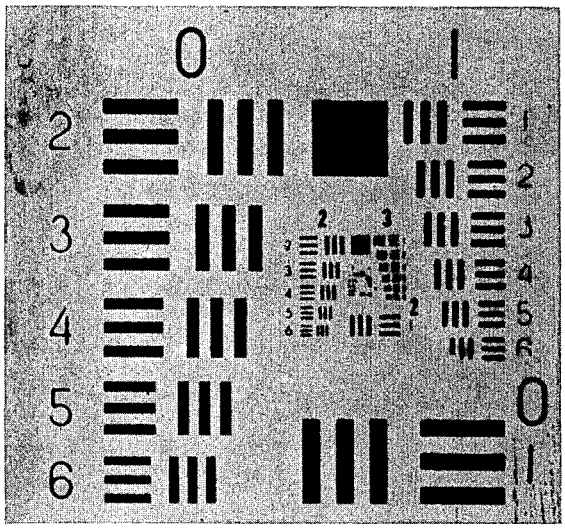
FIG. 3(*a*) is a photograph of the 400th impression produced by the etched printing plate of the present invention.
Figure 3B:
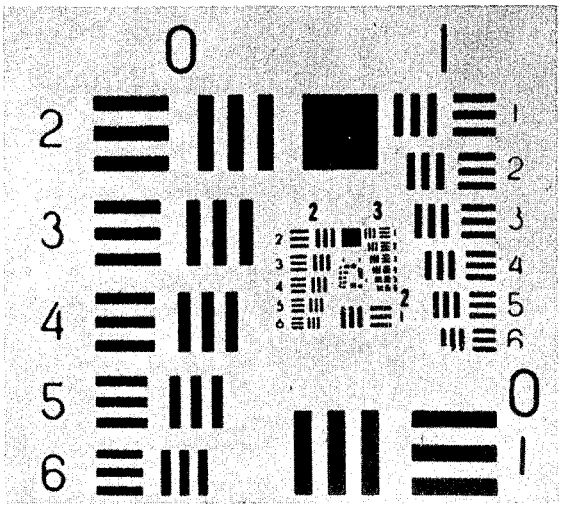

The resulting printing plate was tested on an AM-1250 printing press operating at 9600 pages/hour. Before the plate was mounted on the press, it was treated with a conversion solution to make the bare aluminum surface fully water receptive and the imaged areas fully ink receptive. Van Son's electrostatic conversion solution (Product V2021) when used in full strength was found suitable for this purpose. During the press run Lith-kem's PPC#1 (diluted 7 times in water) solution was used as a fountain solution, and Van Son's electrostatic VS157 black was used as the printing ink. One press run of the same plate over a period of three days produced 100,000 good-quality impressions with no visible deterioration of the image quality or the plate surface. FIG. 3(*a*) and 3(*b*) are photographs of the 400th and 100,000th impression produced using the printing plate of Example 4.

COMPARATIVE EXAMPLES 5

During the course of development of the present invention, coatings containing zinc oxide and a considerable number of different commercial binders were prepared in accordance with the procedure of Example 4. Table I summarizes the results of experiments, which were carried out to determine the electrophotographic and etching characteristics of the binders.

At the initial stage, considerable effort was given to make an etchable plate by using a mixture of Alcogum L-15 resin and DeSoto 312 resin (as described in Table I). The plate displayed satisfactory electrophotographic response and was readily etchable with weak alkaline solvents. However, the plate exhibited a very poor press life (good only for a few hundred copies), apparently because the coatings were slowly dissolved by the alcohol contained in the normal press fountain solution.

Similarly, some of the well-established electrophotographic binders obtained from DeSoto and Celanese were found to be unsuitable because none of them were etchable in mild basic solutions such as $Na_2SiO_3 \cdot 9H_2O$.

These experiments, however, identified that polyvinyl acetate multipolymeric materials produced by the Monsanto Chemical Company and in particular the resin designated as Monsanto 270T, have appropriate properties. Monsanto 270T is described as a self curing polyvinyl acetate-maleate copolymer dispersed in a blend of ethanol and toluene. A small amount of cure takes place upon drying at room temperature, but normally heat is used to accelerate the cure. The curing reaction imparts increased resistance to heat, moisture and solvents. The resin has carboxyl groups available for additional crosslinking with other materials. Accordingly, plates were prepared using Monsanto 270T as described in Example 4. Monsanto 270T was analyzed and found to have a composition similar to the random copolymer described in Example 1 hereinabove and in Example 4 of U.S. Pat. No. 3,317,453 (MacDonald et al.).

TABLE 1

Electrophotographic Properties and Etching Characteristics of Commercially Available Resin Binders[1]

| Polymeric Organic Resin Binders | Electrophotographic Properties Charging/ Dark Decay/ Light Decay[2] | Comments[3] |
|---|---|---|
| Polyvinyl acetate 90%/ Crotonic Acid 10% | V.P./-/- | N.S. |
| Vinyl alcohol 9%/ vinyl acetate 91%[4] | P/V.F./V.P. | N.S. |
| Gantrez AN-8194 + Product 78 3945[5] + Des-312[6] | G/E/E | Not etchable in weak aqueous bases such as $Na_2SiO_3.9H_2O$ |
| A-C copolymer 580 (acrylic acid 11%)[7] | VP/-/- | N.S. poor coating mixture |
| A-C copolymer 5120 (acrylic acid 16%)[7] | VP/-/- | N.S. poor coating mixture |
| Vicol 1261[8] + Des-312[6] (7:3) | G/A/G | Can be etched dilute aqueous base but preparation of proper coating mixture difficult |
| Alcogum L-15[9] + Des-312[6] | G/G/G | Etchable in dilute base; however during the press runs, the coatings dissolved in the alcoholic fountain solution |
| Monsanto 269 | G/E/E | The mixture does not have good adhesion on Al plates and was difficult to etch. |
| Monsanto 270T | E/E/E | See Example 4. |

FOOTNOTES TO TABLE 1

[1]Unless otherwise specified 7:1 w/w ratio of zinc oxide binder was used.
[2]P = Poor; V.P = very poor; F = fast; V.F. = very fast; A = adequate; G = good; E = excellent.
[3]N.S. - Not suitable because the electrophotographic properties were poor.
[4]Scientific Polymer Products
[5]Maleic Anhydride copolymer available from GAF and National Starch
[6]A modified acrylic resin available from Desoto, Inc.
[7]Allied Chemical Co.
[8]North Chemical
[9]L-15 is an acrylic emulsion copolymer available from Alco Chemical Corp.

We Claim:

1. An etchable electrophotographic printing plate comprising:
   (a) an electroconductive support;
   (b) a coating on a surface of the electroconductive support of effective amounts of a photoconductive zinc oxide and of a sensitizing dye dispersed in an organic resin binder, wherein said resin comprises about 60–90 weight percent of $C_2$–$C_4$ alkenyl $C_2$–$C_8$ alkanoate, about 5–30 weight percent of di($C_1$–$C_8$ alkyl) $C_4$–$C_8$ alkenedioate, about 2–8 weight percent of $C_3$–$C_8$ alkenoic acid or $C_4$–$C_8$ alkenedioic acid, and about 0.5–5.0 weight percent of a cross-linking agent.

2. The etchable electrophotographic printing plate of claim 1 wherein the electroconductive support is a grained aluminum plate.

3. The etchable electrophotographic printing plate of claim 1 wherein the organic resin binder comprises about 70 weight percent of a $C_2$–$C_4$ alkenyl $C_2$–$C_8$ alkanoate, about 24 weight percent of a di($C_1$–$C_8$ alkyl) $C_4$–$C_8$ alkenedioate, about 5 weight percent of a $C_3$–$C_8$ alkenoic acid or $C_4$–$C_8$ alkenedioic acid and about 1 weight percent of an epoxy containing cross-linking agent.

4. The etchable electrophotographic printing plate of claim 3 wherein the $C_2$–$C_4$ alkenyl $C_2$–$C_8$ alkanoate is vinyl acetate.

5. The etchable electrophotographic printing plate of claim 3 wherein the di($C_1$–$C_8$ alkyl) $C_4$–$C_8$ alkenedioate is dibutyl maleate.

6. The etchable, electrophotographic printing plate of claim 3 wherein the epoxy-containing cross-linking agent is glycidyl methacrylate.

7. The etchable electrophotographic printing plate of claim 1 wherein the coating comprises about 9–25 weight percent of the organic resin binder about 75–91 weight percent of the photoconductive zinc oxide.

8. The etchable electrophotographic printing plate of claim 1 wherein the coating comprises about 12.5 to about 20 weight percent of the organic resin binder and about 80–87.5 of the photoconductive zinc oxide.

9. The etchable electrophotographic printing plate of claim 1 wherein the coating comprises about 20 weight percent of the organic resin binder and about 80 weight percent of the photoconductive zinc oxide.

10. The etchable electrophotographic printing plate of claim 1 wherein the coating comprises at least about 0.001 to about 0.05 weight percent of the sensitizing dye.

11. The etchable electrophotographic printing plate of claim 10 wherein the sensitizing dye absorbs electromagnetic radiation in the range of about 350–900 nm.

12. The etchable electrophotographic printing plate of claim 1 wherein the electroconductive support is an aluminum plate.

13. The etchable electrophotographic printing plate of claim 1 wherein the electroconductive support is a conductive plastic sheet.

14. The etchable electrophotographic printing plate of claim 1 wherein the coating comprises about 9–25 weight percent of the organic resin binder, about 75–91 weight percent of the photoconductive zinc oxide and about 0.001 to 0.05 weight percent of the sensitizing dye.

15. A process of preparing an etchable electrophotographic printing plate which comprises:

(a) coating onto a face of an electroconductive support a suspension comprising effective amounts of (1) an organic resin binder; (2) photoconductive zinc oxide; and (3) a sensitizing dye in an amount of an anhydrous solvent mixture comprising at least about 10 volume percent of a $C_1$–$C_8$ alcohol and no more than about 90 volume percent of an aromatic and/or alkyl aromatic hydrocarbon sufficient to dissolve said organic resin and said sensitizing dye and to disperse said zinc oxide; and (b) drying said thin film for a time sufficient to remove substantially all said solvent mixture and produce an etchable electrophotographic plate;

wherein said organic resin comprises about 60–90 weight percent of $C_2$–$C_4$ alkenyl $C_2$–$C_4$ alkanoate, about 5–30 weight percent of di($C_1$–$C_8$ alkyl) $C_2$–$C_8$ alkenedioate, about 2–8 weight percent of a $C_3$–$C_8$ alkenoic acid or $C_4$–$C_8$ alkenedioic acid and about 0.5–5.0 weight percent of a cross-linking agent.

16. The process of claim 15 wherein the organic resin comprises about 70 weight percent of a $C_2$–$C_4$ alkenyl $C_2$–$C_8$ alkanoate, about 24 weight percent of a di($C_1$–$C_8$ alkyl) $C_4$–$C_8$ alkanedioate, about 5 weight percent of a $C_3$–$C_8$ alkenoic acid and about 1 weight percent of an epoxy-containing cross-linking agent.

17. The process of claim 15 wherein the electroconductive support is an aluminum plate.

18. The process of claim 15 wherein the thin layer has a thickness in the range of about 5–50 mm.

19. The process of claim 15 wherein the film of the suspension comprises (1) about 9–25 weight percent of the organic resin binder; (2) about 75–91 weight percent of the photoconductive zinc oxide; and (3) about 0.001 to about 0.05 weight percent of the sensitizing dye.

20. The process of claim 15 wherein the anhydrous solvent mixture comprises at least about 10 volume percent of a $C_1$–$C_3$ alcohol and no more than about 90 volume percent of toluene and/or isomeric xylenes.

21. The process of claim 20 wherein the anhydrous solvent mixture comprises about 3 volumes of a $C_1$—$C_3$ alcohol and about 4 volumes of toluene.

22. A process of preparing a printing plate which comprises, in sequence, the steps of:

(a) changing the etchable electrophotographic plate of claim 15 to a voltage in the range of at about 50 to 800 volts;

(b) imagewise exposing a charged surface of said etchable electrophotographic plate to actinic radiation to produce a latent image;

(c) toning said etchable electrophotographic plate with an electrostatic toner to form a toned image;

(d) heating said plate at a temperature and for a time sufficient to fuse the toner on the visual image onto the surface of said plate;

(e) treating the surface of said plate from step (d) with basic aqueous solution comprising $C_2$–$C_8$ alkylamine, $C_1$–$C_8$ alkanolamine, a polyfunctional amine having formula $NH_2[(CH_2)_nNH]_m(CH_2)_nNH_2$ wherein n is 1 or 2 and m is 1–8, alkali metal metasilicate or alkali metal phosphate for a time sufficient to remove the coating comprising organic resin binder, photoconductive zinc oxide, and sensitizing dye in the region wherein said coating is not protected by the toner; and (f) optionally treating the surface of said plate with an acidic aqueous solution comprising phosphoric acid or a $C_2$–$C_4$ alkanoic acid for a time sufficient to remove residual photoconductive zinc oxide at interface of imaged and non-imaged areas.

23. The process of claim 22 wherein a negative potential is applied in step (a).

24. The process of claim 22 wherein a positive mask is used in step (b) and a dry or liquid toner having a negative charge is used in step (c).

25. The process of claim 22 wherein in step (e) a basic solution of aqueous sodium metasilicate is used.

26. The process of claim 22 wherein in step (f) an acidic aqueous solution of propanoic acid is used.

27. The process of claim 22 wherein in step (f) an acidic aqueous solution of phosphoric acid is used.

28. The process of claim 22 wherein the actinic radiation is provided by a diode laser, helium-neon laser, or helium-cadmium laser.

29. The process of claim 22 wherein step (f) is performed and wherein the process further comprises heating the treated plate for a time sufficient to further fuse the toner and to crosslink the polymer resin-zinc oxide-dye coating remaining under the toned imaged areas and thereby producing a more durable printing plate.

* * * * *